US008475236B2

(12) United States Patent
Zhang et al.

(10) Patent No.: US 8,475,236 B2
(45) Date of Patent: Jul. 2, 2013

(54) SANDER HAVING A DAMPING ELEMENT

(75) Inventors: Jiyu Zhang, Nanjing (CN); Shuming Wu, Nanjing (CN); Xunzhuang Qiu, Nanjing (CN); Yi Lu, Nanjing (CN)

(73) Assignee: Chervon Limited, Wanchai (HK)

( * ) Notice: Subject to any disclaimer, the term of this patent is extended or adjusted under 35 U.S.C. 154(b) by 868 days.

(21) Appl. No.: 12/586,113

(22) Filed: Sep. 17, 2009

(65) Prior Publication Data

US 2010/0068977 A1 Mar. 18, 2010

(51) Int. Cl.
*B24B 23/00* (2006.01)
*B24B 27/08* (2006.01)

(52) U.S. Cl.
USPC ..... 451/354; 173/162.2; 451/357; 451/359; 451/451

(58) Field of Classification Search
USPC ..... 451/344, 354, 355, 356, 357, 358, 451/359, 451
See application file for complete search history.

(56) References Cited

U.S. PATENT DOCUMENTS

| | | | | |
|---|---|---|---|---|
| 4,879,847 | A * | 11/1989 | Butzen et al. | 451/344 |
| 6,855,040 | B2 * | 2/2005 | Huber | 451/357 |
| 7,794,308 | B2 * | 9/2010 | Wuensch et al. | 451/344 |
| 2005/0170763 | A1 * | 8/2005 | Sun et al. | 451/359 |
| 2008/0153401 | A1 | 6/2008 | Wuensch et al. | |

* cited by examiner

*Primary Examiner* — Timothy V Eley
(74) *Attorney, Agent, or Firm* — McDermott Will & Emery LLP

(57) ABSTRACT

A sander according to the present invention having a housing, a motor mounted in the housing, wherein the housing comprises an upper housing section and a lower housing section, the upper housing section includes an inner surface, the lower housing section includes a motor housing, the lower housing section at least partially overlapped by the upper housing section, and a grip portion formed on the upper housing section. The upper housing section is connected with the lower housing section through a damping means including at least a damping element positioned on the inner surface the upper housing section and on the periphery of the motor housing section, the damping element engaged with engagement member. The arrangement of the damping means simplifies the connection between the upper and lower housing sections, while effectively reducing the vibrations in the horizontal and vertical directions when the sander is in use.

5 Claims, 2 Drawing Sheets

SANDER HAVING A DAMPING ELEMENT

CROSS-REFERENCE TO RELATED APPLICATIONS

This application claims priority under 35 U.S.C. 119 to CN 200820160320.3 filed Sep. 17, 2008, and is hereby incorporated by reference.

FEDERALLY SPONSORED RESEARCH OR DEVELOPMENT

Not Applicable.

TECHNICAL FIELD

The present invention relates to a sander, and more particularly, to a damping element for a sander.

BACKGROUND OF THE INVENTION

A sander is a commonly used power tool, which is used to polish a work surface typically of wood. Generally, the sander includes a motor, a transmission system providing movement in an eccentric direction, and a sanding plate. During operation, the eccentric rotational movement of the motor is transferred to the sanding plate through the transmission system. Sanding paper or another suitable sanding material is attached to the lower surface of the sanding plate, which is moved together with the sanding plate to polish the work surface.

Prior art sanders have certain disadvantages. For example, the eccentric movement of the sanding plate may unbalance the sander, causing excessive vibrations of the sander. When operating the sander for extended periods of time, the excess vibration may cause the user to become fatigued and the sander hard to control. Two methods are typically used to solve this problem. First, a balance system may be provided to reduce the imbalance and vibration of the sander. Second, a soft rubber or polyurethane material may be used to overlay the grip portion, such that the grip comfort is improved. However, neither of these methods substantially and effectively reduces the vibration of the sander. The present invention provides a sander having reduced vibration for easier handling.

SUMMARY OF THE INVENTION

A sander according to the present invention comprises a housing having an upper housing section and a lower housing section, wherein the upper housing section includes an inner surface, the lower housing section includes a motor housing, the lower housing section is at least partially covered by the upper housing section, and a motor located in the motor housing. A grip portion is formed on the upper housing section. The upper housing section is connected with the lower housing section through a damping means, the damping means comprising at least a damping element, which is positioned on the inner surface of the upper housing section and on the periphery of the motor housing. The sander further includes an engagement member on the inner surface of the upper housing section for receiving the damping element.

With the present arrangement, the upper housing section is connected with the lower housing section through the damping element and engagement member, which makes the connection between the two housings relatively simple, while effectively reducing the vibrations of the sander. Furthermore, the damping element is positioned on the periphery of the lower housing section, effectively reducing the vibrations in the horizontal and vertical directions, relieving potential fatigue of the user.

BRIEF DESCRIPTION OF THE DRAWINGS

The present invention will become apparent from the following detailed description of the preferred embodiment of the invention illustrated in the accompanying drawings, wherein.

DETAILED DESCRIPTION

Figure 1:
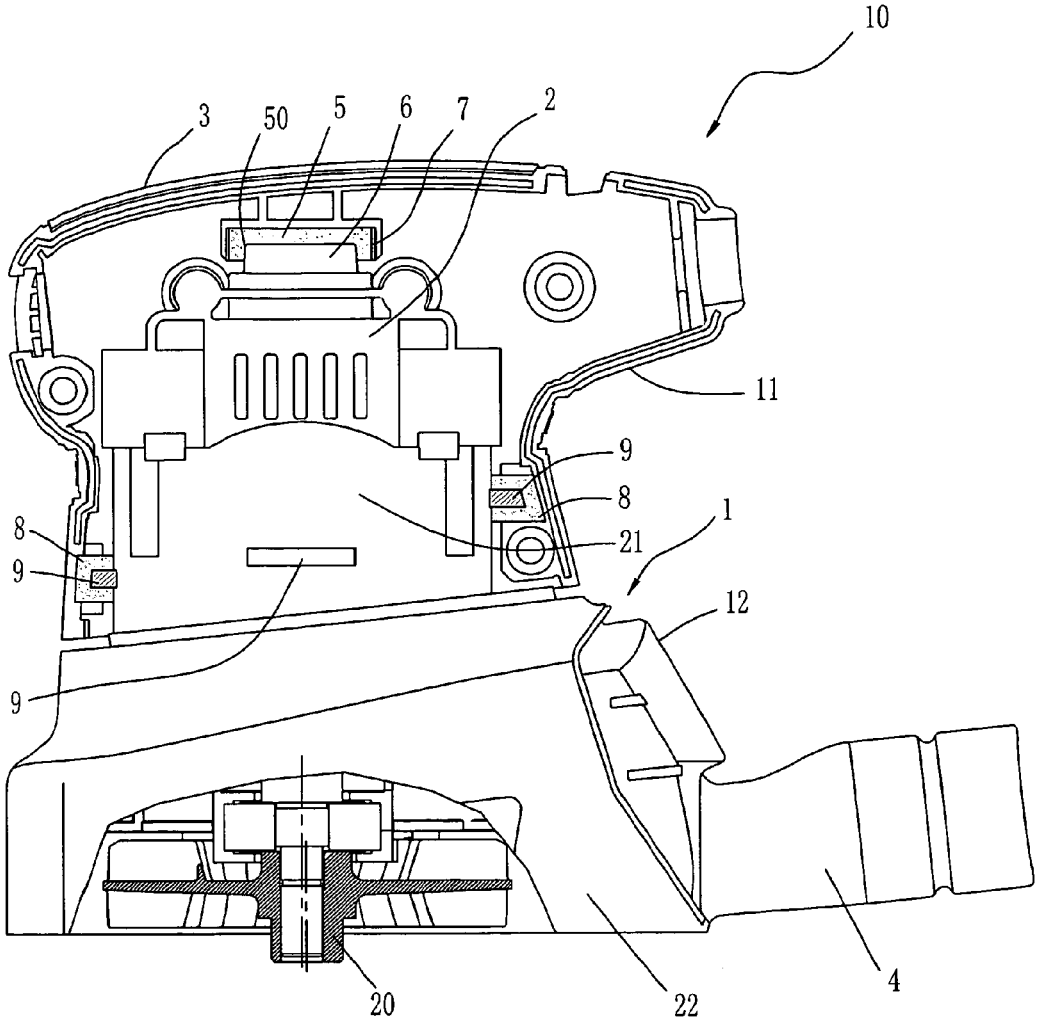
FIG. 1 is a perspective view of a sander of one embodiment according to the present invention.

With reference to FIG. 1, a sander 10 comprises a housing 1 and a motor 2 mounted therein. Generally, the sander 10 further comprises an eccentric means 20. A sanding plate is connected with the eccentric means 20. The rotation movement of the motor is transferred into the eccentric movement of the sanding plate through a transmission system and the eccentric means 20. Sanding paper is attached to the lower surface of the sanding plate and moved together with the sanding plate to polish the work surface.

Figure 2:
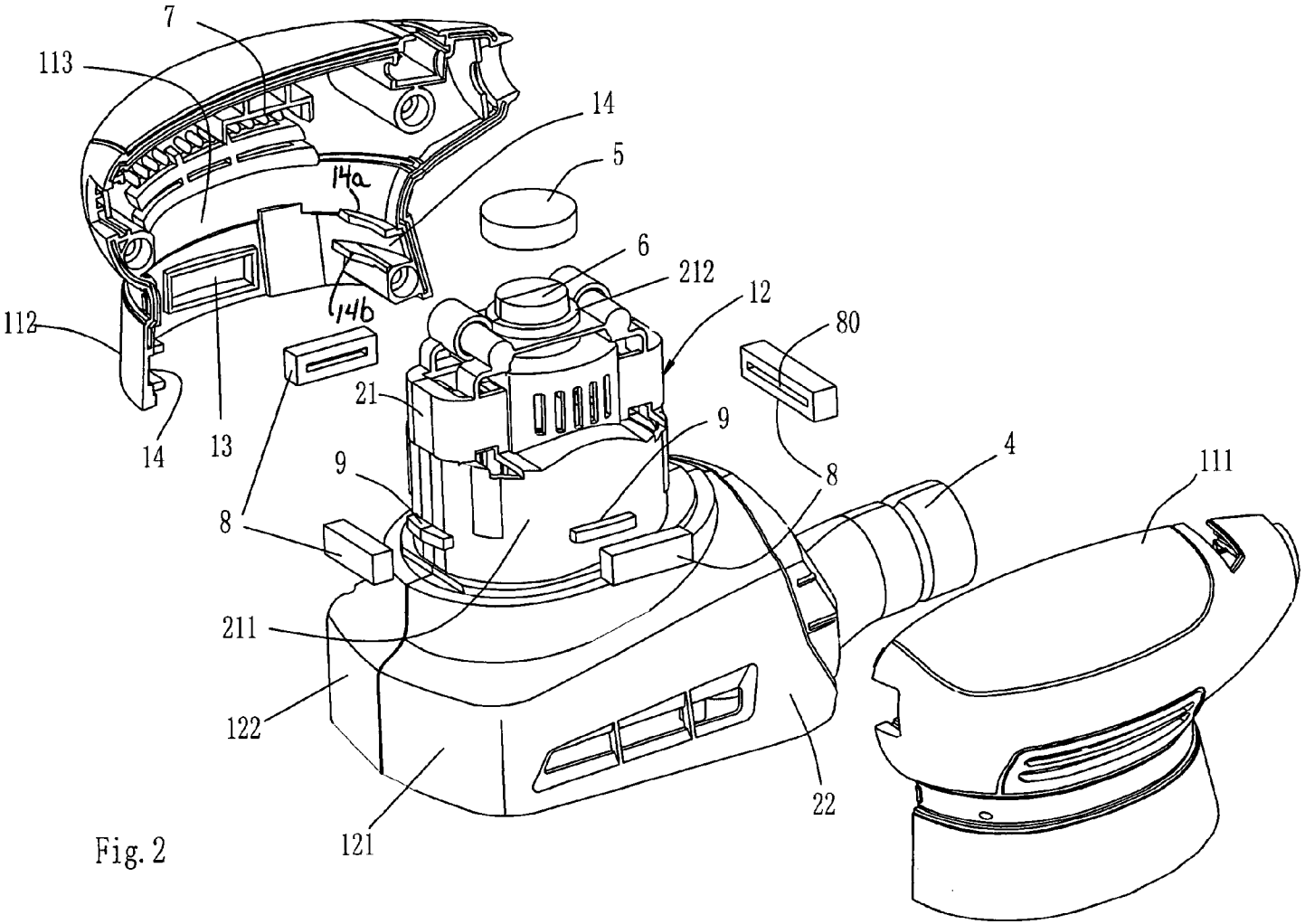
FIG. 2 is an exploded view of the sander of FIG. 1.

With reference to FIGS. 1 and 2, the housing 1 includes an upper housing section 11 and a lower housing section 12. The lower housing section 12 is partially covered by the upper housing section 11, such that the two sections partially overlap with one another. The upper housing section 11 includes an inner surface 113. The lower housing section 12 includes a motor housing 21 and a transmission housing 22. The motor housing 21 is above the transmission housing 22. The motor housing 21 includes a periphery 211 and a top 212. A grip portion 3 is formed on the top of the upper housing section 11, the grip portion being overlaid with soft rubber or other elastic material to improve the grip comfort. A dust extraction port 4 is connected to the rear end of the lower housing section 12. The upper and lower housing sections 11, 12 are respectively composed of left housing parts 111, 121 and right housing parts 112, 122. When assembled, the upper housing section 11 is connected with the lower housing section 12 by a damping means, and the left housing parts 111, 121 are connected with the right housing parts 112, 122 through threaded bolts.

The damping means comprises a first damping element 5 with a cylindrical shape which is made of rubber or other elastic material. The first damping element 5 has a circular recess 50 on its lower surface, the inner diameter of which is approximately equal to the outer diameter of a flange 6 on the top 212 of the motor housing 21 such that the first damping element 5 engages with the flange 6. Correspondingly, the upper housing section 11 is provided with a circular recess 7 on the inner surface 113 of its top which has a downward opening. The inner diameter of the recess 7 is approximately equal to the outer diameter of the first damping element 5, such that the first damping element 5 can be engaged with the recess 7. The arrangement of the first damping element 5 can effectively reduce the amount of vibration in the vertical direction of the sander 10.

The damping means between the upper and lower housing sections 11, 12 further comprises a plurality of second damping elements 8. The second damping elements 8 may be any suitable shape, but are preferably square. The second damping elements 8 may be arranged on the inner surface 113 of the upper housing section 11, one on each side of the upper housing section, and on the periphery 211 of the lower housing section 12, specifically at the overlapping portion of the upper and lower housing sections 11, 12. (FIG. 2). Each second damping element 8 has an elongated groove 80 open on the side inwardly facing the lower housing section 12. The lower housing section 12 further includes a plurality of connection blocks 9 protruding outwardly one on each of its respective sides. The size and shape of the connection block 9 is approximately equal to the size and shape of the groove 80 of the second damping element 8, so the connection blocks 9 can be inserted into the grooves 80, respectively.

The upper housing section 11 includes an engagement member formed on its inner surface 113. The engagement member includes at least two opposing recesses 13 and two opposing slots 14, the positions of which are correspond to that of the second damping elements 8. The recesses 13 are enclosed on three sides, with the opening facing inwardly. The recesses 13 are positioned opposite to each other on the left and right housing part 111, 112 of the upper housing section 11. The two opposing slots 14 are formed from an upper rib 14*a* and a lower 14*b* rib on the inner surface of the upper housing section, and are positioned on the front and rear end of the upper housing section 11.

The size of the engagement member corresponds to that of the second damping element 8, so the damping element 8 can be inserted in the engagement member, when the sander is fully assembled. The first damping element 5 is connected to the lower housing section 12 through the engagement of the recess 50 and the flange 6, while the second damping elements 8 are connected to the lower housing section 12 through the engagement of the grooves 80 and the connection blocks 9. The upper housing section 11 is connected with the first and second damping elements 5, 8 through the engagement of engagement members 7, 13, 14 and the damping elements 5, 8. Thus, the upper housing section 11 is connected with the lower housing section 12 by the damping means. This arrangement allows for a small amount of movement and displacement between the upper and lower housing sections 11, 12 during the operation of the sander, so that the transmission of vibrations between the two housing sections may be counteracted and reduced in a particularly effective manner.

The present invention is not restricted as the embodiments disclosed hereinabove. For example, the damping elements are not limited to a specific geometric shape, as other suitable shapes are available. Furthermore, the number and positioning of the upper and lower damping elements can vary. Accordingly, any substitutes and modifications according to the spirit of the present invention will be regarded as falling within the claims appended hereto.

What is claimed is:

1. A sander comprising:

a housing having an upper housing section and a lower housing section, wherein the upper housing section includes an inner surface, the lower housing section includes a motor housing, the lower housing section being at least partially overlapped by the upper housing section;

a motor mounted in the motor housing;

a grip portion formed on the upper housing section;

wherein the upper housing section is connected with the lower housing section through a damping means, the damping means comprising at least a damping element positioned on the inner surface of the upper housing section and on a periphery of the motor housing;

wherein the lower housing section further includes a plurality of connection blocks.

2. The sander of claim 1, wherein the damping element is adapted for receiving the connection blocks.

3. The sander of claim 1, wherein the upper housing section further includes an engagement member adapted for engagement with the damping.

4. The sander of claim 3, wherein the engagement member comprises at least two recesses and at least two slots.

5. A sander comprising:

a housing having an upper housing section and a lower housing section, wherein the upper housing section includes an inner surface, the lower housing section includes a motor housing;

a motor mounted in the motor housing;

a grip formed on the upper housing section;

a damping means which includes at least two damping elements; and engagement members positioned on the inner surface of the upper housing section; and, wherein the engagement members include at least two recesses and at least two slots positioned opposing with the motor housing.

* * * * *